US009781813B2

(12) United States Patent
Johnson

(10) Patent No.: US 9,781,813 B2
(45) Date of Patent: Oct. 3, 2017

(54) COMMUNICATION MODULE

(71) Applicant: GOOEE LIMITED, St. Albans (GB)

(72) Inventor: Andrew Johnson, Klosters (CH)

(73) Assignee: Gooee Limited (GB)

( * ) Notice: Subject to any disclaimer, the term of this patent is extended or adjusted under 35 U.S.C. 154(b) by 0 days.

(21) Appl. No.: 15/128,849

(22) PCT Filed: Mar. 27, 2015

(86) PCT No.: PCT/IB2015/052294
§ 371 (c)(1),
(2) Date: Sep. 23, 2016

(87) PCT Pub. No.: WO2015/145404
PCT Pub. Date: Oct. 1, 2015

(65) Prior Publication Data

US 2017/0105272 A1 Apr. 13, 2017

(30) Foreign Application Priority Data

Mar. 27, 2014 (GB) ..... 1405570.1

(51) Int. Cl.
*H05B 37/02* (2006.01)
*H05B 33/08* (2006.01)

(52) U.S. Cl.
CPC ..... *H05B 37/0263* (2013.01); *H05B 33/0845* (2013.01); *H05B 37/0272* (2013.01)

(58) Field of Classification Search
CPC ..... H05B 33/0815; H05B 33/0818; H05B 33/0884; H05B 33/0809; H05B 33/0848;
(Continued)

(56) References Cited

U.S. PATENT DOCUMENTS 6,249,089 B1 6/2001 Bruwer
2003/0073461 A1 * 4/2003 Sinclair ..... G08C 17/02 455/557

(Continued)

FOREIGN PATENT DOCUMENTS

CN 102495604 A 6/2012
DE 202012001947 U1 11/2012

(Continued)

OTHER PUBLICATIONS

GB Search Report and Written Opinion of GB Application No. GB1505342.4, dated Mar. 29, 2016.

(Continued)

*Primary Examiner* — Douglas W Owens
*Assistant Examiner* — Syed M Kaiser
(74) *Attorney, Agent, or Firm* — Lisa J. Moyles; Janelle A. Bailey

(57) ABSTRACT

An electronic 2-way communication module suitable (1, 2, 3) for 2-way communication with a luminaire (6) is disclosed. This is adapted to be installed in series into the power supply (7, 8) to the luminaire, and it has (i) a housing assembly; (ii) live and neutral power input terminals; (iii) live and neutral power output terminals; (iv) a power supply unit; (v) a dimmer unit controller; (vi) a wireless communication interface adapted to receive data/operating instructions and to relay data to a remote repository; and (vii) a wired connection between said electronic 2-way communication module and said luminaire adapted for the 2-way transmission of data between the module (1,2, 3) and the luminaire (6) and vice versa. This electronic 2-way communication module provides for the first time the ability not only to control a luminaire remotely but also to transmit data wirelessly from a luminaire to a remote repository, using a
(Continued)

module that is simply wired in series with a cable supplying power to said luminaire.

12 Claims, 11 Drawing Sheets

(58) Field of Classification Search
CPC ..... H05B 33/0896; H05B 37/0245; H05B 37/0254; H05B 41/3925; H05B 41/391; H05B 41/2828; H05B 33/0803; H05B 37/0272; H05B 33/0857; H05B 33/0887
USPC ..... 315/246, 152, 297; 439/226
See application file for complete search history.

(56) References Cited

U.S. PATENT DOCUMENTS

| | | | | |
|---|---|---|---|---|
| 2004/0260470 | A1* | 12/2004 | Rast | G06Q 10/06 701/300 |
| 2006/0215345 | A1 | 9/2006 | Huizenga | |
| 2008/0157939 | A1 | 7/2008 | Sutardja | |
| 2009/0085500 | A1 | 4/2009 | Zampini, II et al. | |
| 2011/0001626 | A1 | 1/2011 | Yip et al. | |
| 2011/0095687 | A1 | 4/2011 | Jonsson | |
| 2011/0115448 | A1* | 5/2011 | Elliott | H05B 37/0254 323/235 |
| 2011/0215735 | A1 | 9/2011 | Herbst et al. | |
| 2012/0056490 | A1 | 3/2012 | Bruwer | |
| 2012/0112654 | A1 | 5/2012 | Choong et al. | |
| 2012/0139426 | A1 | 6/2012 | Ilyes et al. | |
| 2012/0274234 | A1 | 11/2012 | Campbell et al. | |
| 2013/0175931 | A1 | 7/2013 | Sadwick | |
| 2013/0210252 | A1 | 8/2013 | Ilyes | |
| 2013/0257284 | A1 | 10/2013 | Van Wagoner et al. | |
| 2014/0097758 | A1* | 4/2014 | Recker | H05B 37/0272 315/152 |
| 2014/0265880 | A1 | 9/2014 | Taipale et al. | |

FOREIGN PATENT DOCUMENTS

| | | | |
|---|---|---|---|
| WO | WO-2013142292 | A1 | 9/2013 |
| WO | WO-2013184669 | A1 | 12/2013 |
| WO | WO-2013184682 | A1 | 12/2013 |

OTHER PUBLICATIONS

International Written Opinion of International Application No. PCT/IB2015/052294, dated Sep. 14, 2015.
International Search Report of International Application No. PCT/IB2015/052294, dated Sep. 14, 2015.

* cited by examiner

Mains Power Dimmer block diagram

Numbers 101, 102, 107, 108 and 109 are optional. In a typical application one or more of these would be required for minimum operation.

109: The communication interface can be UART, SPI, I2C etc and/or a combination thereof.

109: A high level communication device such as Zigbee, Z-Wave, KNX, DALI, Bluetooth etc or a combination thereof would be connected.

COMMUNICATION MODULE

FIELD OF THE INVENTION

The invention relates to a new type of 2-way communication module. These modules are particularly applicable, but in no way limited, to the 2-way communication with light engines, light fittings or luminaires connected to a power supply, particularly where that connection is by means of plug-in type connectors. These new 2-way communication modules enable a light engine, light fitting or luminaire to be controlled remotely as well as enabling various types of data gathered by the luminaire to be relayed back to a central repository, including a 'cloud' repository.

BACKGROUND TO THE INVENTION

There is an increasing demand from users to have control over electrical equipment and for that control to be exercised remotely, rather than just from a fixed switch or dimmer control, such as a wall switch/dimmer. This remote control requirement is particularly applicable to the control of lighting units or luminaires in and around the home and in and around the work place. In the case of luminaires, these remote control requirements can include, by way of example only, an on/off function including a timed or motion sensor controlled on/off function, a dimming function, changing the colour temperature of the light or changing the colour of the light emitted and touch sensor control. This list of examples is not intended to be exhaustive but rather serves to illustrate the wide range of functionalities than might be controlled by remote operation. Further examples are listed later in the description.

In addition to the requirement to control light fittings/luminaires remotely, luminaires are becoming more intelligent in that they are now capable of collecting data both about the environment around the luminaire and about the performance of an individual light engine/luminaire itself. Furthermore, this intelligence and information gathering capability is increasing rapidly with each new generation of luminaires. There is therefore a need to relay various types of data from a light fitting/luminaire back to a data repository for the purpose of analytics, reporting and reactive functions.

Many of the bulbs, lamps and luminaires now on sale include LED light sources. As LEDs enter mainstream lighting applications consumers expect their operation to mimic traditional lighting units such as incandescent bulbs and fluorescent tubes. Dimming of LEDs presents a challenge because of the unique power demands of LED chips. An LED emits light when the forward voltage is greater than a threshold governed by the semiconductor material used in the LED.

A number of systems already exist for dimming LED light sources. In addition to dimming by means of an Integrated Circuit in the light engine, analogue dimming of an LED is possible. This involves reducing the forward voltage applied to the LED, leads to a noticeable change in the colour of the light. By contrast, digital dimming generally produces almost no change in the colour of the emitted light. One method of digital dimming relies on keeping the forward voltage constant and rapidly cycling the LED on and off. Altering the duty cycle, which is the ratio of the pulse duration to the signal period, changes the brightness of the light emitted. Digital dimming can be achieved by combining an LED driver with a suitable logic chip generating the duty cycle, or it can be achieved in integrated circuits having both functions in one package.

A number of systems already exist by which remote control can be achieved. For example technical standards for Digital Addressable Lighting Interface (DALI)® have been developed for network-based systems that control lighting in building automation. Typically a DALI® network consists of a controller and one or more lighting devices (e.g. electrical ballasts and dimmers) each of which have a built in DALI® interface. The controller can monitor and control each light by means of a bi-directional data exchange. Data is transferred between the controller and the devices by means of an asynchronous, half-duplex serial protocol over a two-wire data bus. It will be appreciated that this requires specialist cabling and special DALI® compatible control components within or associated with each luminaire to be controlled. This is both expensive to install, requires a skilled electrician and/or controls engineer to perform the installation, and is very difficult to retro-fit into an existing lighting installation where no such control system was ever envisaged.

In a further example, digital dimming technology can be installed in a home or in an office using an RE (radio) control system such as those supplied by Rako Controls Limited of Knight Road, Rochester, Kent, ME2 2AH. However, planning a lighting project including this type of dimming technology can be confusing, especially with the vast array of lamp types and fittings now available. Typically a special wall-mounted control panel is required and a radio controlled dimmer unit, which is physically quite large in size, has to be wired in series with each luminaire, or group of luminaires to be controlled. This is both an expensive solution and inevitably requires a skilled electrician and/or controls engineer to perform the installation.

A further example of a known control system is the EYENUT® system supplied by Harvard Engineering PLC of Tyler Close, Normanton, Wakefield, West Yorkshire, WF6 1RL which uses the ZigBee protocol and components. This type of system requires an EYENUT enabled driver and/or dimmer to be connected to every luminaire in the system. These are controlled by one or more EYENUT Gateway devices, with each Gateway device being connected by Ethernet cabling to an EYENUT hub which in turn is connected to a web interface.

As with the other systems described above, a skilled electrician and/or controls engineer is required to perform any installation. Plus there are considerable costs involved.

These are just three examples of known wireless protocols that have application in the lighting field and further protocols are described below.

By way of further prior art, WO2013142292 discloses the application of a Digital Control Ready (DCR) lighting fixture disposed in one location and coupled to a Digital Light Agent (DLA) disposed in a second location to control the light output of the DCR light fitting. A DCR-enabled lighting fixture therefore responds to digital control signals from a separate digital light agent (DLA) instead of analogue dimming signals.

None of the arrangements described above can be easily adapted to retrofitting to an existing lighting installation, including adapting an existing installation so that it can be controlled by smart home systems utilising for example, the ZigBee® Alliance wireless protocols. Nor do these arrangements allow for the reporting and relaying of data to and from a light fitting/luminaire in a two-way communication process.

It is the object of the present invention to overcome or at least mitigate some of the problems with the prior art outlined above, and to provide a cost effective 2-way communication module that also provides a remote control function, and that is easy to install both in new installations and as a retrofit, without any need for additional wiring or rewiring, and preferably without the installation process requiring any tools or the services of a skilled electrician/controls engineer.

SUMMARY OF THE INVENTION

According to a first aspect of the present invention there is provided an electronic 2-way communication module according to Claim 1. Thus there is provided an electronic 2-way communication module suitable for 2-way communication with a luminaire and adapted to be installed in series into the power supply to said luminaire, wherein said electronic 2-way communication module comprises:—

(i) a housing assembly;
(ii) live and neutral power input terminals;
(iii) live and neutral power output terminals;
(iv) a power supply unit;
(v) a dimmer unit controller;
(vi) a wireless communication interface adapted to receive data/operating instructions and to relay data to a remote repository;
(vii) a wired connection between said electronic 2-way communication module and said luminaire adapted for the 2-way transmission of data between the module and the luminaire and vice versa.

This electronic 2-way communication module provides for the first time the ability not only to control a luminaire remotely but also to transmit data wirelessly from a luminaire to a remote repository, using a module that is simply wired in series with a cable supplying power to said luminaire.

Preferably the wired connection between the electronic 2-way communication module and said luminaire comprises power line communication technology. Power line communication technology and protocols are well known and require that both the communication module and the luminaire include the appropriate electronic components and chip sets to make a particular power line communication protocol function. This is, in most cases, a simpler arrangement than installing a separate data cable between the electronic communication module and a luminaire in addition to the existing power cable connection.

Preferably the housing assembly houses all the components of the electronic 2-way communication module, other than the wired connection between said electronic 2-way communication module and said luminaire and this provides within a single housing assembly all the components necessary for a user to achieve remote control of an electrical item, such as a luminaire or a fan, as well as relaying data from that electrical item to a remote repository.

Preferably the module includes power input terminals and power output terminals and these terminals are preferably integral to the housing assembly. This enables the module to be of the 'plug-and-play' type.

In a particularly preferred embodiment the housing assembly includes input and output terminals complementary to the corresponding features of the luminaire, such that the electronic communication module can be installed in between the two parts of an existing connector block for fast and easy installation of the electronic communication|module into the connector block of the luminaire, and in-line with the power supply to the luminaire. This is an important feature of the present because it means that certain remote control functionality, such as on/off and dimmer control, can be provided without the need to employ skilled electrician and/or a controls engineer. By simply inserting the specially designed and compatible communication module in line within an existing plug-in type two part electrical connector block the desired remote control functionality can be introduced to any number of luminaires that become individually addressable.

In a further preferred embodiment the housing assembly further comprises a lock and release mechanism complementary to a lock and release mechanism of the plug-in type two part electrical connector block of the luminaire. This ensures a firm and secure connection of the electronic communication module into the connector block of the luminaire.

In a particularly preferred embodiment said luminaire comprises an on-board dimmer unit, the dimmer unit controller in the electronic communication module controlling the on-board dimmer unit in the luminaire.

In a further preferred embodiment the communication module further comprises a dimmer unit, preferably of the TRIAC dimmer type. This provides an electronic communication module that can be used with luminaires that have no dimmer function built in to the circuitry inside the luminaire but which are dimmable, and provides individual remote luminaire dimmer functionality. This provides significantly greater control than simply replacing a wall light switch with a wall mounted dimmer switch, which by its very nature dims all the luminaires connected to that dimmer switch.

Preferably the electronic communication module further comprises a power transfer and AC communication unit.

Preferably the electronic communication module further comprises a real time clock.

Preferably the electronic communication module further comprises a memory module.

Preferably the memory module is adapted to store information regarding the functioning of the luminaire selected from the group of information comprising:

(a) the number of times the luminaire has been turned on/off;
(b) the total duration the luminaire has been illuminated;
(c) the duration that has elapsed from the initiation of the luminaire;
(d) the lumen output of an LED light engine associated with the luminaire when not dimmed;
(e) the operating temperature of an LED light engine associated with the luminaire.

Preferably the electronic communication module further comprises a touch sensor interface as a user interface to detect user actions.

Preferably the electronic communication module further comprises a status display unit.

Preferably the dimmer control unit is of the TRIAC dimmer type. This enables, for the first time, a 'plug-and-play' electronic control unit that provides dimming control function to any luminaire that includes a dimmable lamp or bulb, be it an incandescent, halogen or LED bulb/lamp.

According to a further embodiment of the present invention there is provided an electronic communication module as described herein in combination with a luminaire/lamp comprising a programmable IC incorporating a dimming function, the dimmer unit controller in the electronic communication module controlling the on-board dimmer unit in the luminaire.

Preferably the programmable IC associated with the lamp/luminaire includes one or more of the functionalities selected from the group of functions comprising:

Switch mode power supply control (bucking and fly-back topologies);

On chip temperature measurements;

Capacitive Touch and Proximity sensing;

Ambient light sensing for automatic night/day activation/deactivation;

Bi-directional Optical data transfer;

Power line communications;

Timer function (auto off etc);

Accepting commands (e.g. dimming) from a normal wall dimmer switch;

Lumen maintenance;

Temperature management;

Color temperature adjustment;

RGB control;

HV LED control (i.e. no transformer/inductor required);

PIR motion detection (external PIR required);

Smoke detection (external smoke detector required).

More preferably communication between the electronic communication module and the luminaire/lamp is by way of power line communication.

Electronic 2-way communication modules according to this invention can be used in combination with a wide variety of electrical items. According to a further aspect of the present invention there is provided an electronic 2-way communication module suitable for 2-way communication with an electrical item and adapted to be installed in series into the power supply to said electrical item, wherein said electronic 2-way communication module comprises:—

(i) a housing assembly;

(ii) live and neutral power terminals;

(iii) live and neutral power terminals;

(iv) a power supply unit;

(v) a dimmer unit controller;

(vi) a wireless communication interface adapted to receive data/operating instructions and to relay data to a remote repository;

(vii) a wired connection between said electronic 2-way communication module and said electrical item adapted for the 2-way transmission of data between the module and the electrical item and vice versa. Where power line communication is used to transmit data between the module and the electrical item, the electrical item comprises the necessary hardware and software to make this two way transmission possible.

BRIEF DESCRIPTION OF THE DRAWINGS

Preferred embodiments of the present invention will now be described, by way of example only, with reference to the accompanying drawings wherein.

DESCRIPTION OF THE PREFERRED EMBODIMENTS

Figure 1:
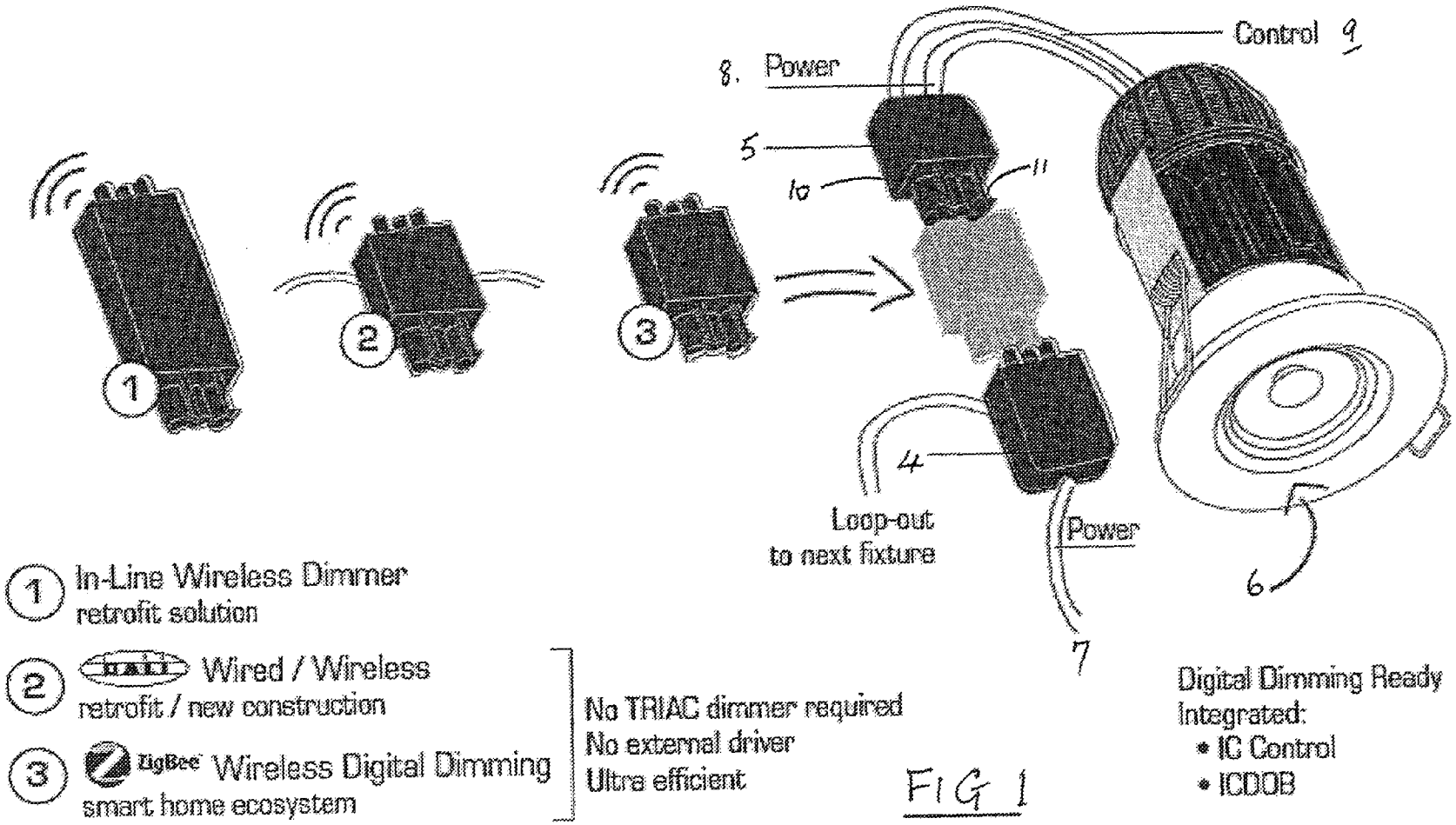
FIG. 1 illustrates in schematic form an electronic 2-way communication module adapted to fit in series within an existing plug-in type two part electrical connector block providing power to a luminaire.

The present invention will now be described by way of examples only. These are not the only ways that the invention may be put into practice, but they are the best ways currently known to the applicant.

The present invention provides a new type of electronic 2-way communication module that can be inserted in series in the power supply cable to a luminaire, either as an inline module/connector block or, preferably, as a plug-in connector block that can be inserted into known types of plug-in type two part electrical connector blocks. Such connector blocks are well known in the electrical trade and a wide variety are already commercially available. Three examples that have particular application in the lighting sector are the FASTFIX® Rapid Install System supplied by Aurora Limited, the CLICK® system supplied by Scolmore International Limited of Scolmore Park, Landsberg, Lichfield Road Industrial Estate, Tamworth, Staffordshire, United Kingdom, B79 7XB, and the Wieland® connectors supplied by Wieland Electric GmbH of Brennerstraβe 10-14, 96052 Bamberg, Germany.

These versatile lock and release connectors allow for the safe installation and subsequent replacement of a variety of light fittings or luminaires or other electrical items such as fans. The terms "light fitting" and "luminaire" are considered to have the same meaning and will be used interchangeably in the context of this description. Similarly the terms "lamp" and "bulb" are considered to have the same meaning, namely a device for giving out light that fits into some type of holder.

The term luminaire has a broad meaning in this context and is to be understood to encompasses similar terms such as light fixture, light fitting and lamp. The term lamp is to be understood to encompass similar terms such as light bulb, light or LED light engine. An LED light engine is a combination of one or more LED modules together with the associated electronic control gear or LED driver. An LED module contains one or more LEDs, together with further components, but excludes the control gear.

In practice when installing a luminaire the mains wiring is connected to the primary section of a connector and the necessary testing is then carried out. The appropriate luminaire is connected to the secondary section of the connector, if not already supplied in this fashion by the manufacturer. The installation is completed by plugging the primary and secondary connectors together, ensuring that they are locked in combination, and finally positioning the luminaire in its desired position. Both 3 pole and 4 pole connectors of this type are available.

It will be appreciated that as well as providing a safe and secure mains supply to the luminaire, these connectors allow quick and easy replacement of a luminaire simply by the user operating the quick release locking/unlocking system and pulling the connector apart. No live wires or connections are ever exposed and no tools are required to perform this operation. Nor is there any need for a qualified electrician. So long as the new luminaire comes with a secondary connector already attached it can simply be plugged in to the primary connector, again with no tools required.

As well as illustrating certain embodiments of the present invention. FIG. 1 shows a known arrangement whereby a luminaire 6 can be connected to a power source using such a connector assembly. Thus FIG. 1 shows a power source 7 which has live, neutral and earth connections, all of which are connected to a first or primary part 4 of a plug-in type two part electrical connector block. In this description the part of the connector block connected to the power source is referred to as the primary section and the part connected to the luminaire is referred to as the secondary section. A second or secondary part 5 of the plug-in type two part electrical connector block is connected to the luminaire 6. In normal, use prior to this invention, the luminaire is connected to mains power by simply push fitting first part 4 and second part 5 together, ensuring that locking lugs 10,11 on the secondary part 5 engage with and lock into corresponding apertures in the primary part 4. This plug-in type two part electrical connector block can be easily unplugged to permit easy removal and replacement of the luminaire. This can be done without any tools, re-wiring or the services of an electrician or controls engineer. A quick release locking mechanism of some type is usually provided as an integral part of the connector housing to avoid the two parts from coming apart accidentally.

Versatile as these connectors are for making mains or low voltage power connections, they do not include any control or communication functionality, and certainly no remote control or remote data reporting functionality. Currently that type of control is usually provided by a wall switch, a specialised control panel or remote communication module as part of a sophisticated controls package using a dedicated communication protocol. In the case of LED luminaires these often require special dimming drivers with remote control built in, or remote control built in to each LED luminaire. ZigBee® and DALI® as discussed above are just two of the communication protocols that currently find favour, but there are many others (see below).

An example of an electronic 2-way communication module according to the present invention is also illustrated schematically in FIG. 1. In this example the electronic module is shown connected to a digital dimming ready LED downlight 6 but it will be understood that it could be used connected to any piece of electrical or electronic equipment where remote control of some function is required. A conventional two part electrical connector block with a primary section 4 and a secondary section 5 is shown connecting power line 7 to the luminaire 6. A plug in electronic module, shown in grey scale in FIG. 1 located between the primary and secondary sections of the connector block. During assembly, one of the electronic communication modules 1, 2 or 3, which are shown as alternatives, is plugged in series in between sections 4 and 5. The electronic 2-way communication module is thus adapted to be connected in series into the power supply to the luminaire/lamp. These modules incorporate all the communications interface, dimming unit controller, and optionally a dimmer unit, and associated components/circuitry necessary to control all the desired function of the luminaire, and to relay data collected by the luminaire back to a remote data repository. In the example shown in FIG. 1, the necessary control signals are transmitted to the luminaire along control cable 9, and the power is supplied along cable 8. The control signals can be BiWire® signals, and are preferably PWM (pulse width modulation) signals and cable 9 is connected to a dimmer unit in the luminaire. Other wired communication protocols can be used for controlling the dimmer. Although cables 8 and 9 are shown as separate cables, these can be combined into a single multi-core cable.

Figure 2:
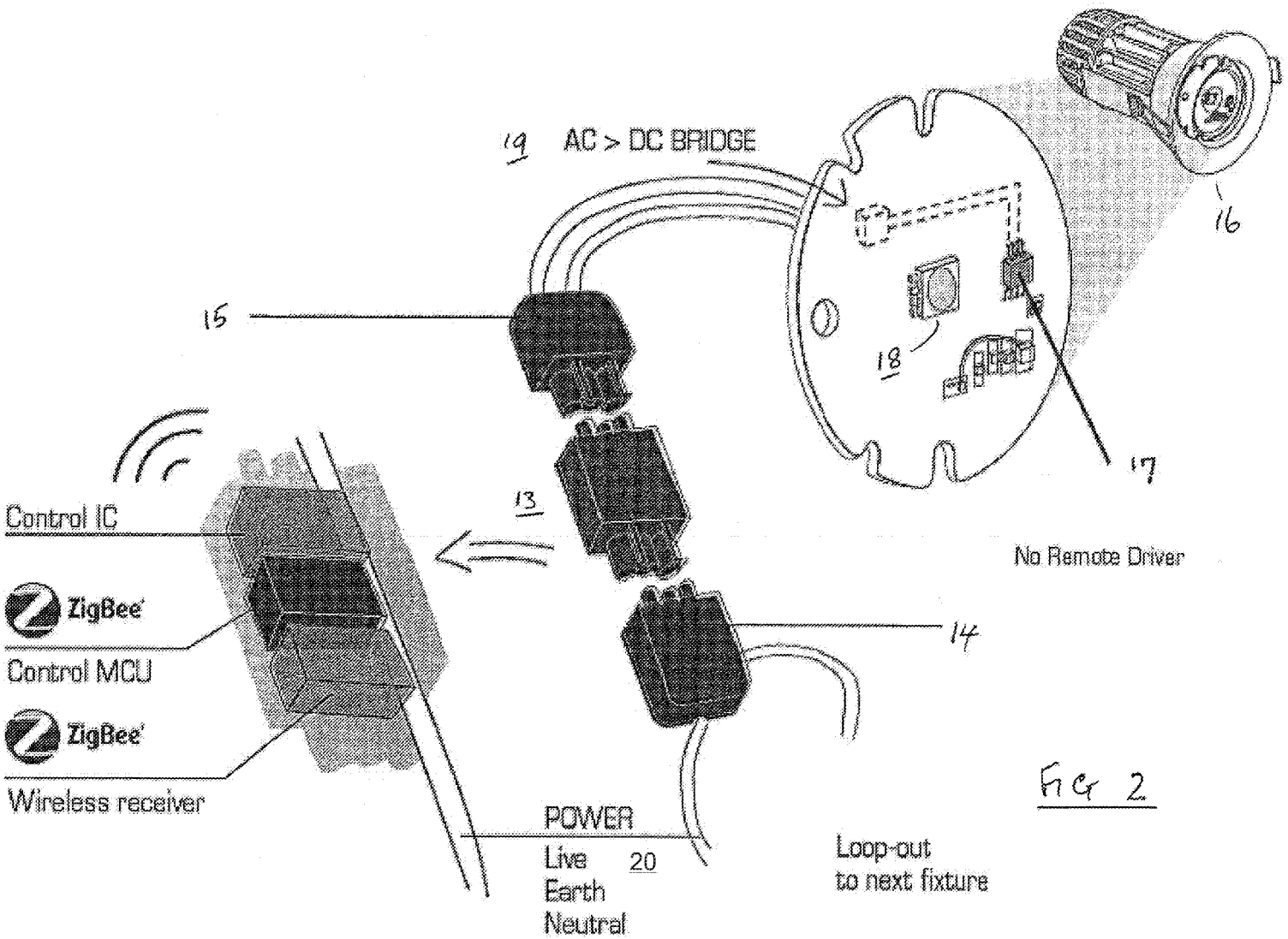
FIG. 2 illustrates in schematic form the components of an electronic communication module shown in FIG. 1 and its interconnection with an LED light engine and associated PCB.
Figure 5:
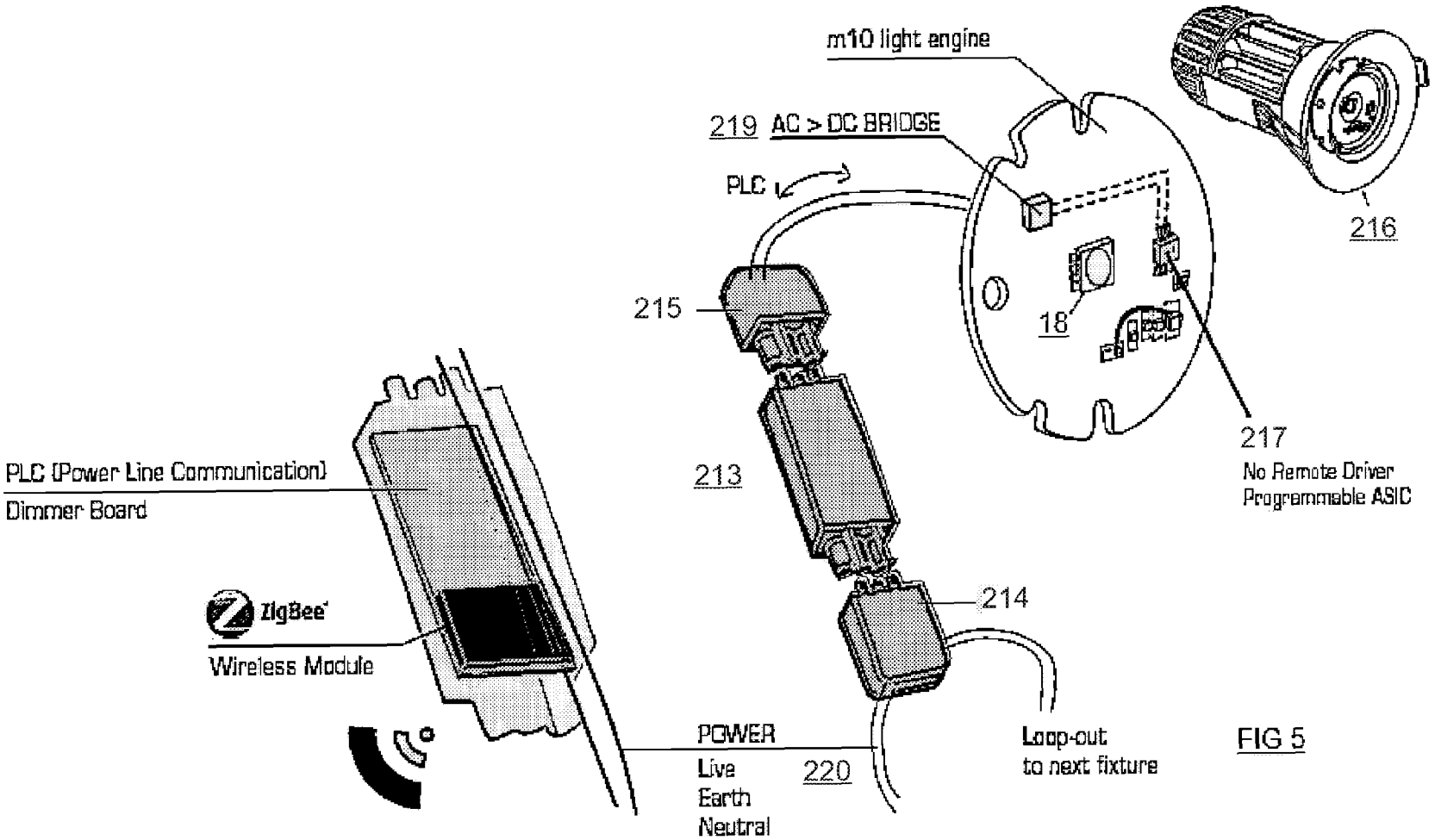
FIG. 5 illustrates in schematic form the components of an electronic communication module similar to that shown in FIG. 2 and its interconnection with an LED light engine and associated PCB.

Although separate power 8 and control 9 cables are shown for clarity purposes in FIGS. 1 and 2, in a preferred embodiment the control signals are simply transmitted down the conventional mains/power cable that connects the connector block, shown in FIG. 1 as 5 and in FIG. 2 as 15, to the integrated circuit and driver on the LED PCB using known power line communication technology. Power-line communication (PLC) carries data on a conductor that is also used simultaneously for AC electric power transmission Thus in this embodiment there would only be a conventional mains/power cable connecting the luminaire 6 to the connector block section, shown in FIG. 1 as 5 and in FIG. 2 as 15, exactly as in the prior art arrangement. This configuration is shown in FIG. 5, in which an electronic communication module 213 comprises a ZigBee wireless module and a PLC dimmer unit controller, and the control signals are passed to the dimmer 217 via a mains cable. Again, the electronic communication module is adapted to be connected in series into the power supply to the luminaire/lamp The various examples of communication module 1, 2 and 3 shown in FIG. 1 will now be described in more detail. As explained above, a variety of technical standard for network-based systems for controlling lighting in buildings have already been developed. It is an object of the present invention to make use of these existing, preferably wireless, standards in a communication interface in the communication module, as well as being able to use those standards yet to be developed. Existing technologies include ZigBee® as used in module 3 in FIG. 1, module 13 in FIG. 2, and module 213 in FIG. 5, and DALI®, as used in module 2 in FIG. 1. Other useful wireless technical standards and protocols include Z-Wave®, LoWPAN, JenNet-IP, INSTEON®, X10®, Bluetooth® and Wi-Fi®. This list is not exhaustive but serves to indicate the wide range of standards and protocols that can be employed in this invention. In addition, there may be new protocols developed in the future that could have good application in the present areas of technology. It is intended that this disclosure and the communication modules and systems described herein can be operated using any suitable wireless protocol/technical standard. That is to say, any of these protocols, when properly configured with the necessary components and circuitry, can be used to send control signals to an electronic communication module according to the present invention and thus on to an IC module in the LED lamp/luminaire or to a dimmer module, either built in to the circuitry within a luminaire or lamp, or within the communication module itself.

It is an important advantage of the electronic 2-way communication modules of the present invention, and the IC in the LED unit that they communicate with, that if a new wireless protocol is adopted or additional functionality is required, the old electronic module can be removed and a new electronic 2-way communication module can simply be inserted in its place. This is a very easy change in make and no tools or professional technical expert are required when a quick release two part electrical connector version is used.

It is a further advantage that whichever type of wireless protocol is used to communicate with the electronic communication module, the control signals from that electronic communication module to the luminaire/lamp, and any data/information sent back from the luminaire/lamp to the communication module, are communicated using the same protocol. Thus the luminaire/lamp is able to respond appropriately to these control signals regardless of which wireless technology is used to instruct the electronic communication module. Various suitable protocols for these control signals are known, such as X10 and PWM, and others are under development. It is intended that the present invention can operate using any suitable communications protocol.

Figure 3:
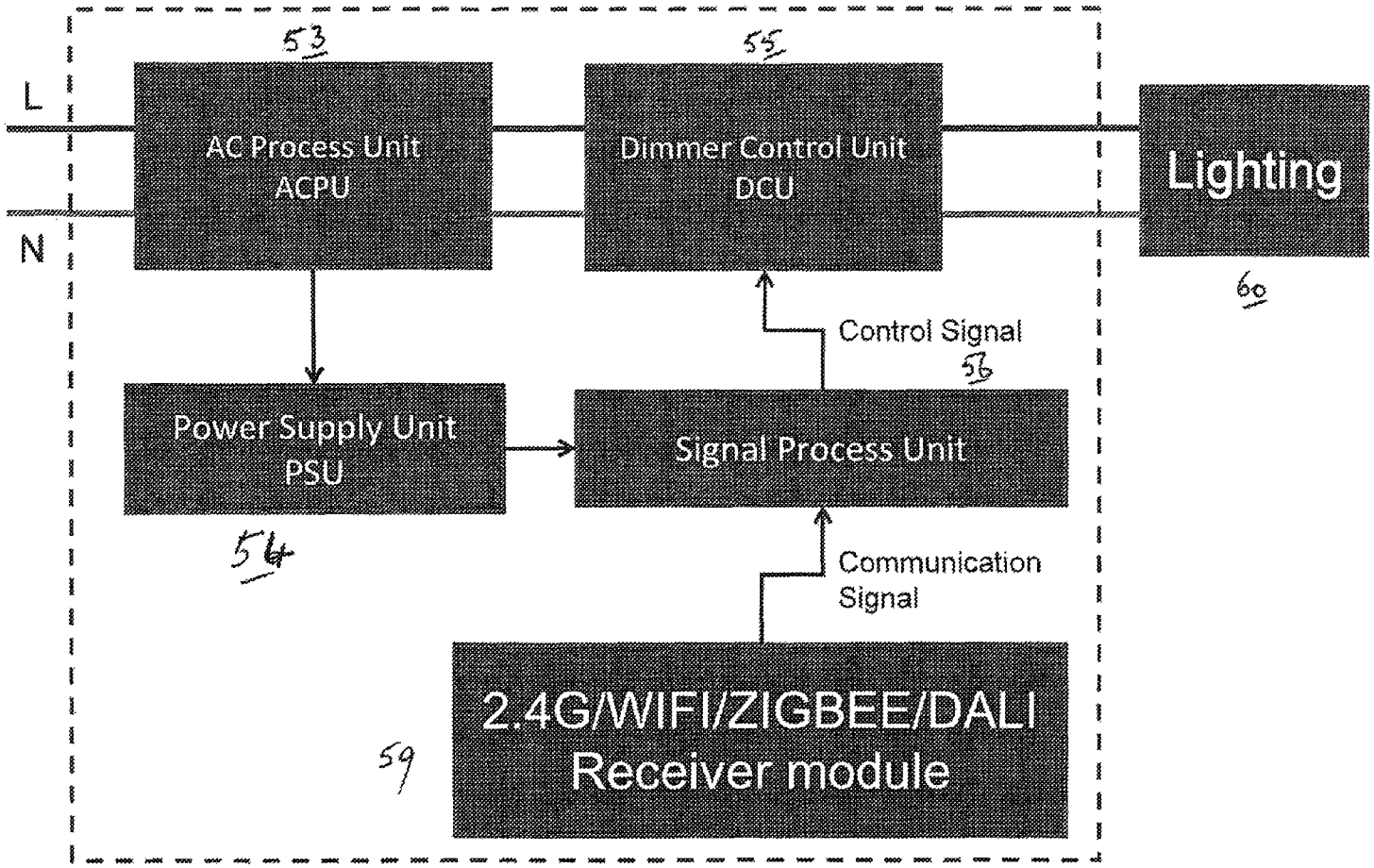
FIGS. 3 & 4 illustrate in block diagram form the components of two types of electronic communication module that include dimmer unit controller/dimmer control units.

A variety of dimming modules or technologies have already been developed for LED light engines and recently these have been miniaturised into integrated circuits (IC) or microchips such that they can be incorporated onto the PCB on which the LED light engine is mounted, or they can be incorporated elsewhere within an LED luminaire or lamp. The present invention in these embodiments makes use of LEDs which contain this IC "on board" dimmer technology.

Where the luminaire does not contain a built in dimmer module that can be controlled by signals from the electronic communication module, but the LED luminaire circuitry is nevertheless configured such that the luminaire is dimmable, then an in-line wireless dimmer, such as module 1 as shown in FIG. 1, can be used. Referring to the schematic block diagram shown in FIG. 3, this shows an electronic communication module that includes a 2-way communication interface 59 and associated signal processing unit 56, together with a dimmer control unit 55 that includes a dimmer unit. The dimmer unit is preferably of the TRIAC type that finds application in conventional dimmer switches.

This type of dimmer unit is compatible with so-called 'dimmable luminaires', including dimmable LED luminaires that have the capability to translate signals from a TRIAC type dimmer into the rapid pulsing used to control LED light levels. It will however be appreciated that other types of analogue and digital dimmer units could be used within a communication module according to the present invention in order to achieve the desired dimming function. Dimming units are continually being developed and this invention is intended to include known and yet to be developed dimming units and dimming technologies, including digital AC dimmers and TRIAC dimmer emulators.

Figure 4:
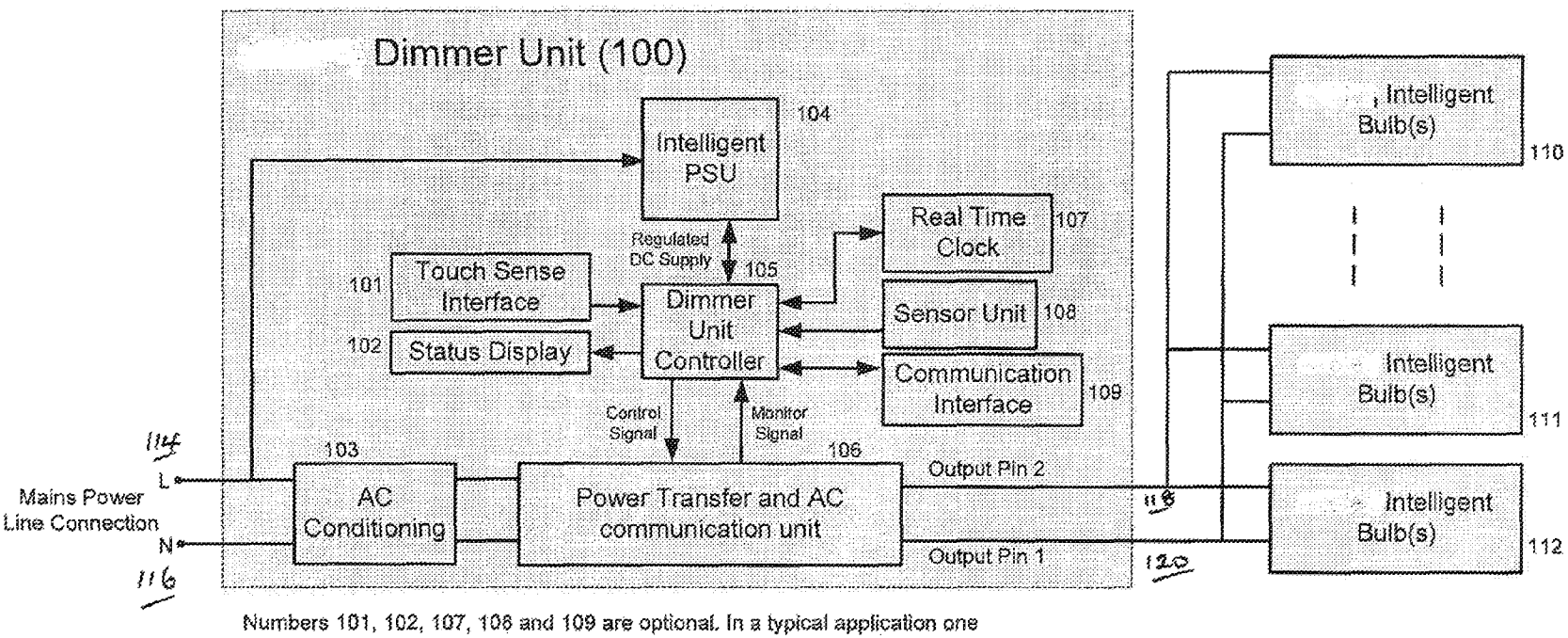

A further example of an electronic 2-way communication module 100 according to the present invention is illustrated schematically in FIG. 4. Electronic communication module 100 includes a live power input terminal 114, a neutral power input terminal 116, a live power output terminal 118, and a neutral power output terminal 120. Input and output earth terminals (not shown) may also be provided. Electronic module 100 further includes an AC conditioning module 103 connected to a power transfer and AC communication unit 106. Each of the output terminals 118, 120 are electrically connected to power transfer and AC communication unit 106. The electronic module 100 further includes a dimmer unit controller 105 and a communication interface 109. The dimmer unit controller 105 is electrically connected to an intelligent power supply unit 104, and receives electrical power there from. The above components are all located within an electronic communication module housing assembly of the type shown schematically in FIGS. 1 and 2 as 1, 2, 3 or 13 or 213 in FIG. 5.

In the embodiment shown in FIG. 4, electronic communication module 100 receives control information in the form of wireless signals received by communication unit 106, which decodes the control information and passes the information to dimmer unit controller 105. Dimmer control unit 105 sends a control signal via the unit 106 to regulate the intensity of light emitted by the luminaire. Dimmer control unit 105 can for example cause the luminaire to be switched off, switched on fully, or to emit light of an intermediate intensity, according to the control information received.

An important feature of this invention is that regardless of the nature of the wireless technology/protocol used to receive wireless information at the electronic communication module, the output control signals sent out by the electronic communication module to the IC in the LED lamp/luminaire are always of the same format or protocol. This means that if for example a different wireless protocol is used at a later date, or additional functionality is required, then the user simply needs to remove the old communication module and install the appropriate new electronic communication module. The system is therefore future proof in this regard.

In preferred embodiments such as the ones shown in FIGS. 1 2 and 5, the housing assembly housing modules 1, 2, 3, 13 and 213 include a lock and release mechanism and input and output terminals complementary to the corresponding features of the plug-in type two part electrical connector block of the luminaire, such that the electronic communication module can be installed in between the two parts of an existing connector block for fast and easy installation of the electronic communication module into the connector block of the luminaire. Again, this can be done without any rewiring or tools and does not require the services of an electrician or control engineer.

The present invention is particularly versatile in that other remote control functionality can be incorporated into these electronic communication modules. For example, LEDs are available in which the colour temperature of the emitted light can be varied. LEDs are also available in which the colour of the light emitted can be varied. Examples of this known functionality are available from Super Bright LEDs Inc., St Louis, Mo., USA. However, as with other prior art technology, any lighting system incorporating this technology has to be designed and specified before installation, and requires expensive and bulky control units to be installed by skilled electricians or control engineers. A further disadvantage is that these known control units can each only handle a limited number of lamps or luminaires.

In contrast, by using an electronic communication module according to the present invention, a communication module including the appropriate signal generating function is simply wired in series with or inserted between the connector blocks associated with each lamp/luminaire that needs to be controlled remotely. In the latter case no tools, specialist technician or specialist knowledge are required.

In addition, the communication between the electronic communication module and the integrated circuit associated with the luminaire is preferably by power line communication along the power cable connecting the electronic communication module to the LED luminaire or lamp. This power line communication technology is well known and a variety of different power line communication technologies and protocols are available to select from, as determined by the appropriate expert. This means that an electronic communication module according to the present invention can communicate with any LED device which has the corresponding power line communication function built in to its integrated circuitry.

The functionality of the IC module in the LED luminaire or lamp and the interaction between that IC and the electronic communication module is clearly an important feature of the present invention. One preferred IC option is a Microcontroller ASIC (MASIC) which provides a cost effective but programmable (ROM) platform for intelligent LED lights. Set out below is a list of functions that such a chip can perform. This list of functions in not exhaustive but rather serves to illustrate the wide range and variety of functions that can be incorporated into en electronic communication module/IC combination.

- Switch mode power supply control (bucking and fly-back topologies);
- On chip temperature measurements;
- Capacitive Touch and Proximity sensing;
- Ambient light sensing for automatic night/day activation/deactivation;
- Bi-directional Optical data transfer;
- Power line communications;
- Timer function (auto off etc);
- Accepting commands (e.g. dimming) from a normal wall dimmer switch;
- Dimming functions without external dimmer;
- Lumen maintenance;
- Temperature management;
- Colour temperature adjustment;
- RGB control;
- HV LED control (i.e. no transformer/inductor required);
- PIR motion detection;
- Other sensor data collection, management, storage and data transfer, including smoke detection data.

Each of the functions above can be expanded into for specific applications. For example, the MASIC device can be provided with the necessary analogue elements to interface directly to a photo diode or phototransistor (3c-5C) US. By adding this single component the following functions and features becomes possible:

- Measurement of ambient light. This enables automatic activation of an LED lamp/luminaire when it gets dark and switching it off when it is light.
- It also very elegantly allows for data transfers and hence configuration from smart phones, tablets, laptops etc without any further costs. This can be via the screen or via the flashlight mechanism on the phones etc.

The result of this functionality means that a standard LED lamp/luminaire with a 3c extra component can be bought by a consumer and then the consumer can configure the lamp/luminaire using their smart phone or tablet to select an auto off period, or to make it automatically switch on at night, at a light level they choose and for a selected period only. These functions were always desirable but previously a supplier had to stock every function in a separate product. Now they are available in one LED lamp/luminaire and the user simply selects the functions they want by running an app on their phone, tablet, laptop, PC or other device, gaining incredible functionality and flexibility.

A further example relates to colour temperature. Some applications desire warm white for ambience, and others cold white for energy and attention etc. Now a single lamp/luminaire can offer all temperature ranges from say 3000K to 5000K in whatever steps the manufacturer wants to offer. Once again these colours are selectable with the user's smart phone/table/laptop app. In this case additional colour LED's must be incorporated into the LED light engine.

Optionally the LED device may be programmed to cycle through the colours, offering colder colour during working ours and becoming warmer as the night wears on to help the body with normal sleeping patterns.

One further important aspect is the functionality this technology makes possible with regards to networks, home/building automation and power management. Currently it is extremely costly to install a home automation system for lighting and even more difficult to maintain such a system as the user's needs change and more devices are added to the system over time. Anything that is changed requires input from a professional technical expert.

In the past the lamps/luminaires were not part of the network, but were simply a dumb load. And each lamp/luminaire had to be individually wired to a network node in order to be individually controllable. This was very costly in a new build and usually required complete rewiring of an existing building or home. There was also a problem of how to link a new or extra lamp/luminaire into the network. How and with what do you program it?

Using the present invention all these problems disappear because each lamp/luminaire fitted with an electronic 2-way communication module is individually addressable. The user simply runs the home automation app on a chosen computing device, selects the position to install the lamp on the Graphical User Interface (GUI) and then configures the lamp via the optical data transfer interface. Now the lamp has an address or handle in the network and can be addressed to perform individual functions even though it is on the same power line with several other lamps.

Essentially a user can set all this up by himself (or his teenage child), without having to involve a professional expert, and when getting home at night can for example activate several lights in the house by selecting a single icon on the smart phone. By way of example, if the user arrives home late at night he/she may activate the porch light for 30 minutes, the stairs light for 30 minutes and the bedroom light until it is switched off.

In summary, the combination of an electronic 2-way communication module fitted in line with the LED lamp/luminaire power supply in combination with an intelligent, programmable 'chip on board' in the LED lamp/luminaire provides many levels of sophisticated control for the user. These range from simple dimming functions to creating and augmenting a complex building control and automation system. As mentioned above, the IC can measure temperature (no added components), motion detection (extra PIR only required), smoke (sensor added) and feed this information back into the network over the power line or wired data connection to the electronic 2-way communication module and from there wirelessly to a remote data repository.

As indicated above, other remote control functionality that can be incorporated into these modules includes, but is not limited to:

Touch sensor/proximity sensor input(s), as for example described in U.S. 201210056490 (Frederick Bruwer and U.S. Pat. No. 6,249,089B1 (Azoteq Pty Ltd);

Motion sensors to turn the luminaires on and off or alter the brightness of a luminaire in response to the detection of movement in a space;

Time input(s) from a real time clock to turn the luminaire on and off on a timed basis;

Light input(s) from one or more light sensors to turn the luminaire on/off in response to the ambient light level.

These functionalities are known per se in the lighting field and the technology can be easily incorporated into the appropriately programmable microprocessor chip.

With regards to suitable user interfaces to interact with and instruct an electronic 2-way communication module, a wide variety of options are available. These include Apps for iPhones® or other smart phones, Apps for iPads® or other tablet devices, programs for a PC, and dedicated remote control units including wall mounted remote control units. Apps of various description and functionality are now ubiquitous and once again the technology necessary to develop such Apps and devices is either known or within the skill of a competent software designer.

It will be appreciated that if no plug-in type two part electrical connector block is in place in an existing installation, or a luminaire/light fitting is supplied without a plug-in type two part electrical connector block, then one can simply be installed, in order that an electronic communication module according to the present invention can be used.

Figure 6:
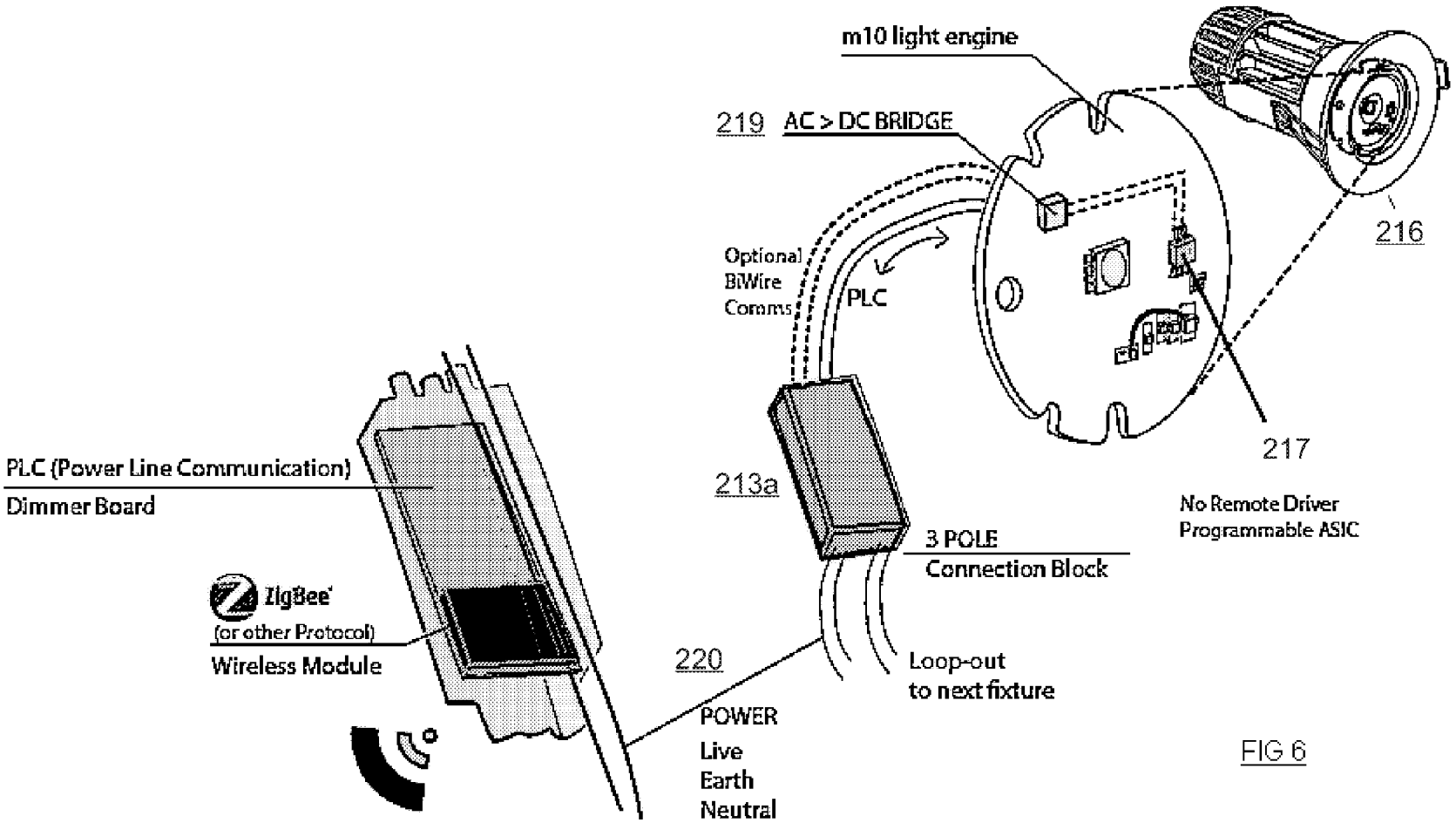
FIG. 6 illustrates in schematic form the components of a further electronic communication module and its interconnection with an LED light engine and associated PCB.

Alternatively and as shown in FIG. 6, the in-line electronic communication module 213*a* is installed by connections made directly to the mains cable 220 before it reaches the luminaire 216 by screw fix or push fit connectors (not shown). Again, electronic communication module 213*a* is adapted to be connected in series into the power supply to the luminaire/lamp.

In summary the electronic 2-way communication module is connected in-line between the luminaire and the power supply. For installations in which the luminaire includes a dimmer that is able to communicate with the electronic communication module via PLC protocol, communication between the electronic communication module and the luminaire is via the power cable, and a signal cable is not required. Power-line communication (PLC) is a protocol in which data is carried on a conductor that is also used simultaneously for AC electric power transmission.

A signal cable is also not required where the electronic communication module communicates with the dimmer using a near field protocol, such as Bluetooth®.

For installations in which a dimmer unit is located in the luminaire/lamp then the dimmer unit must be able to communicate with the electronic communication module. This communication between the electronic module and the luminaire dimmer unit could be by power line communication via the power cable, or via an additional communications cable as described above. Various communication protocols are known and available for this purpose including X10 and Pulse Width Modulation (PWM). Pulse-width modulation is a modulation technique that controls power supplied to electrical devices.

It will be appreciated that improved protocols for such communication are constantly in development and may become available in the future, and which can be applied to this approach for remotely controlling a luminaire by using a corresponding communication interface, and/or by using a corresponding protocol for providing information to the luminaire from the dimmer unit controller and vice versa.

Figure 7:
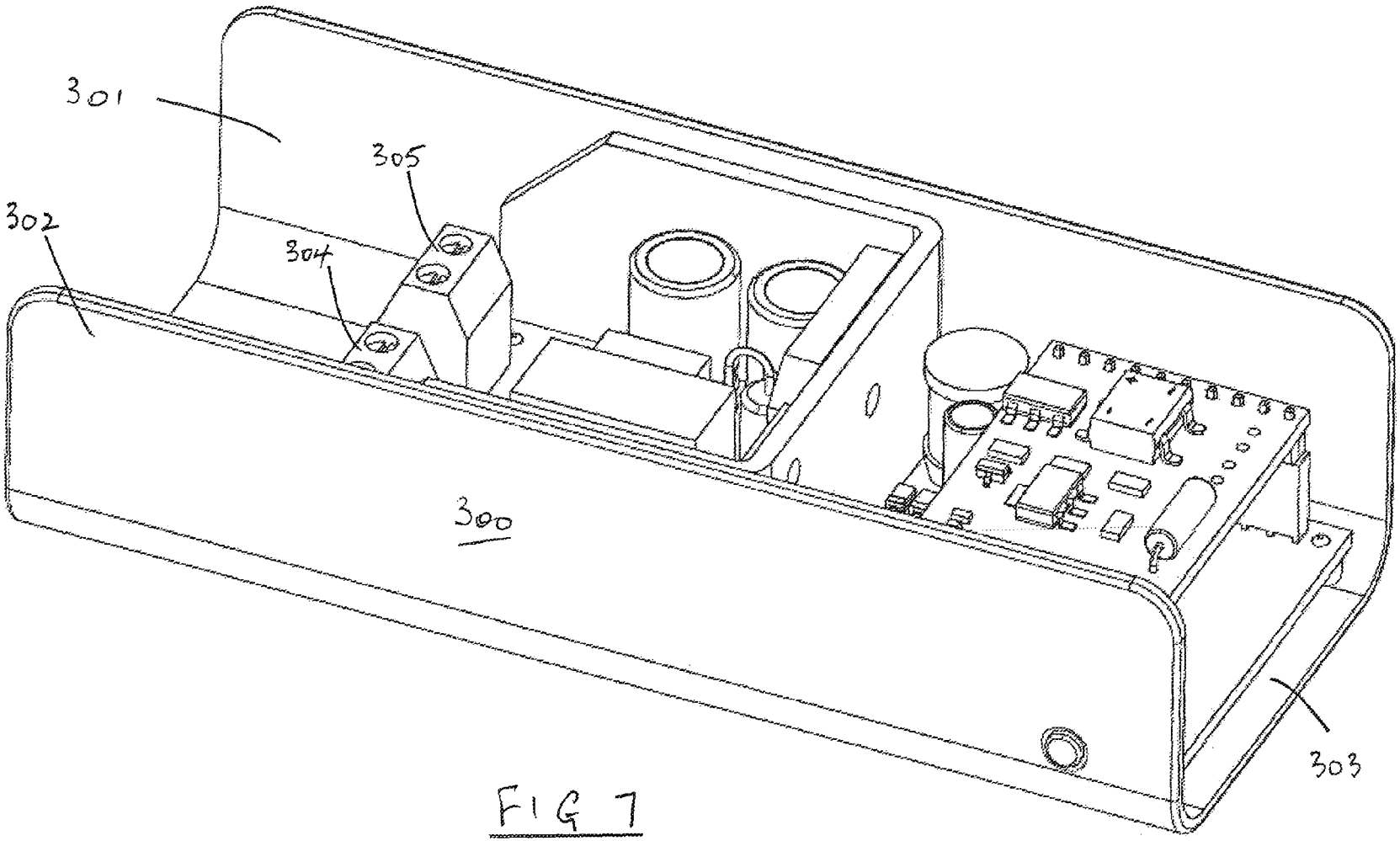
FIGS. 7 and 8 illustrate perspective and plan views respectively of a further electronic communication module with the top of the housing assembly removed to expose a schematic view of the components.
Figure 8:
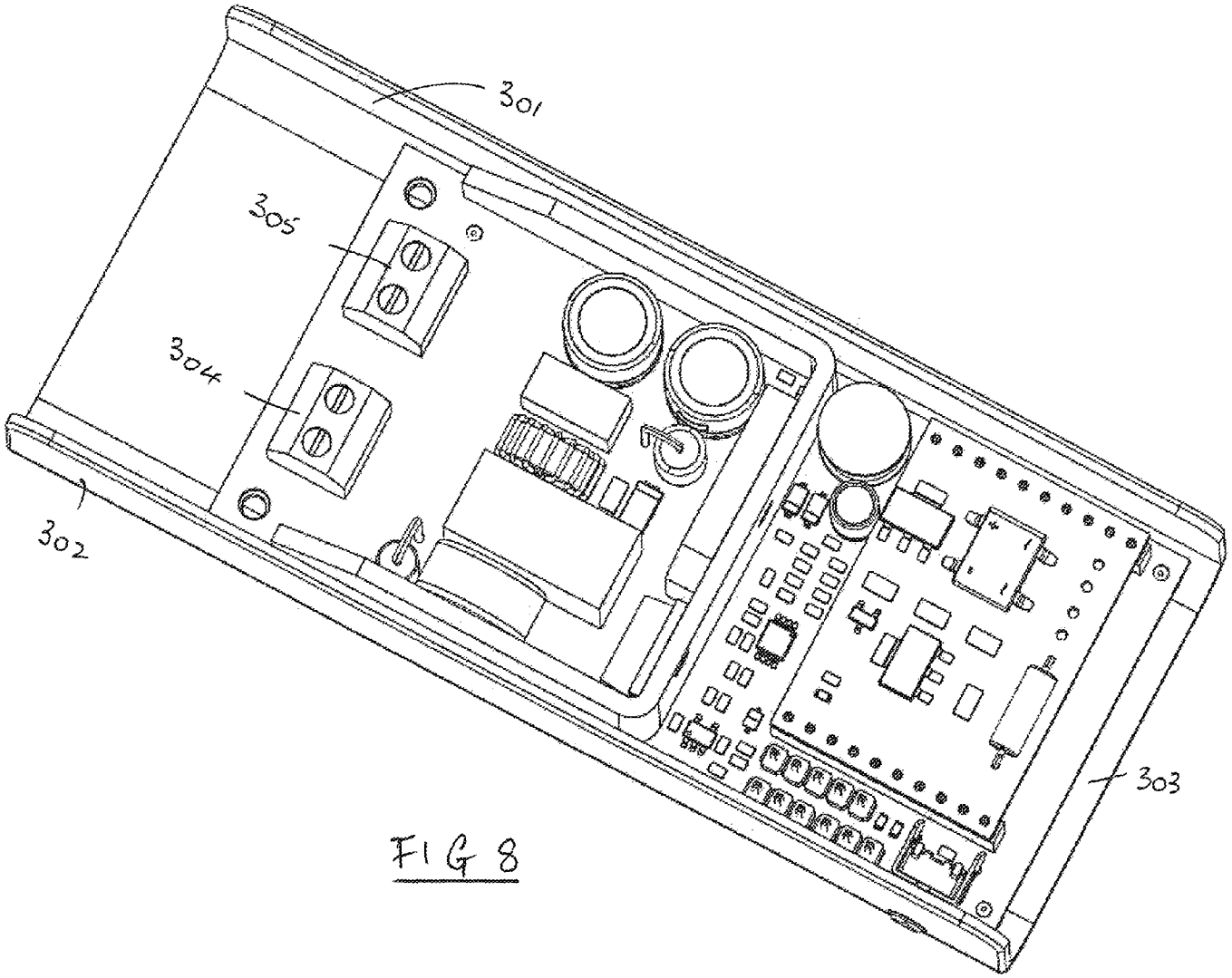
Figure 9:
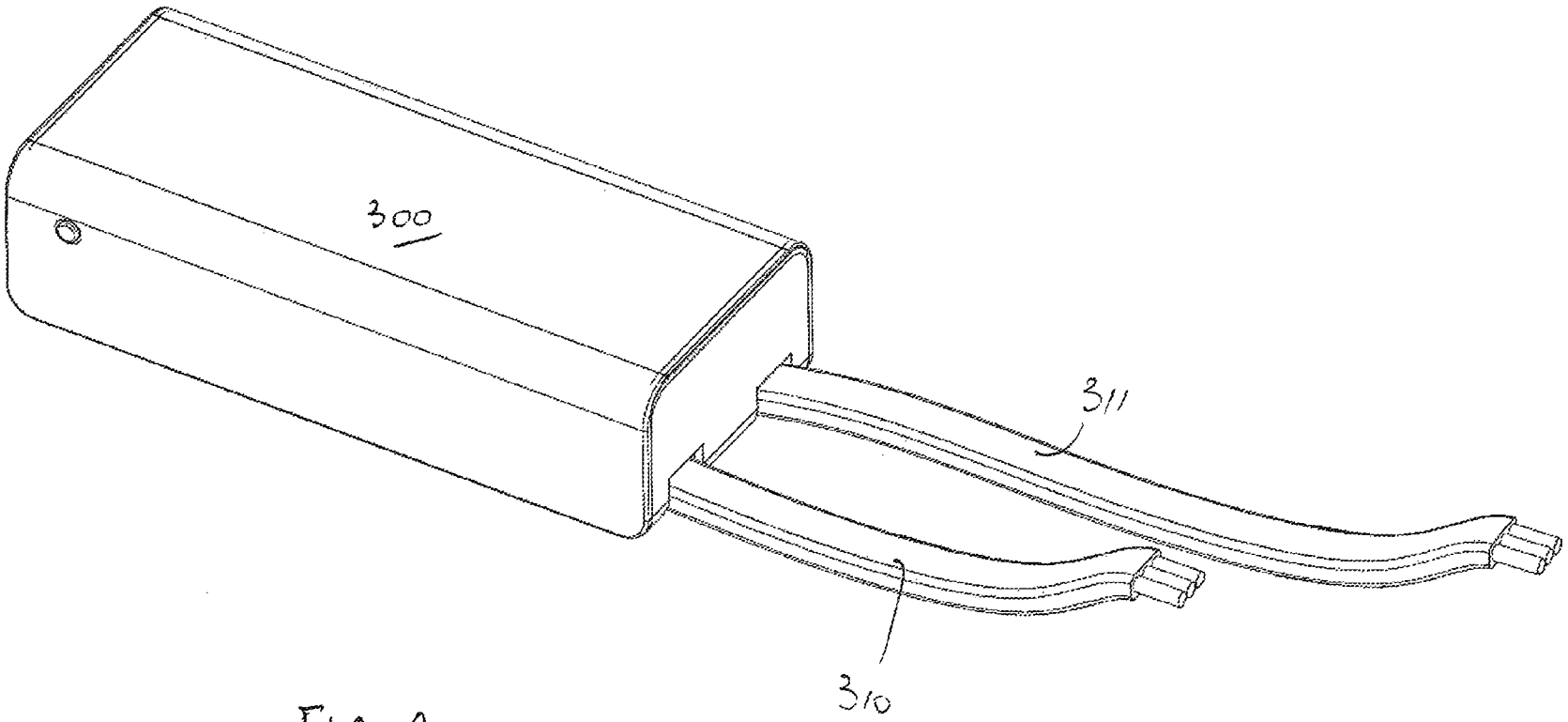
FIG. 9 illustrates the electronic communication module of FIG. 7 with the housing assembly cover in place and input and output power line wires attached.
Figure 10:
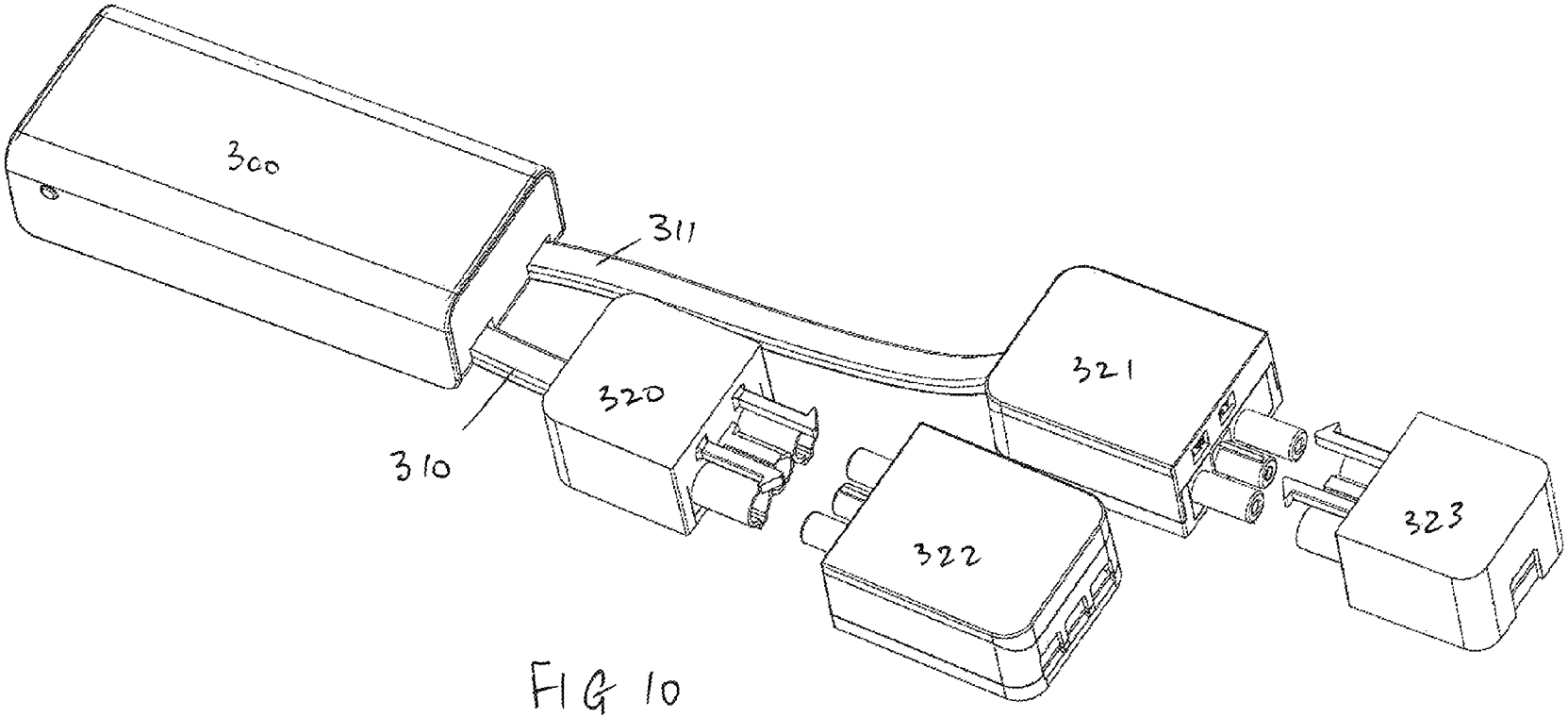
FIG. 10 illustrates the input and output wires shown in FIG. 9 attached to respective FASTFIX® connectors.
Figure 11:
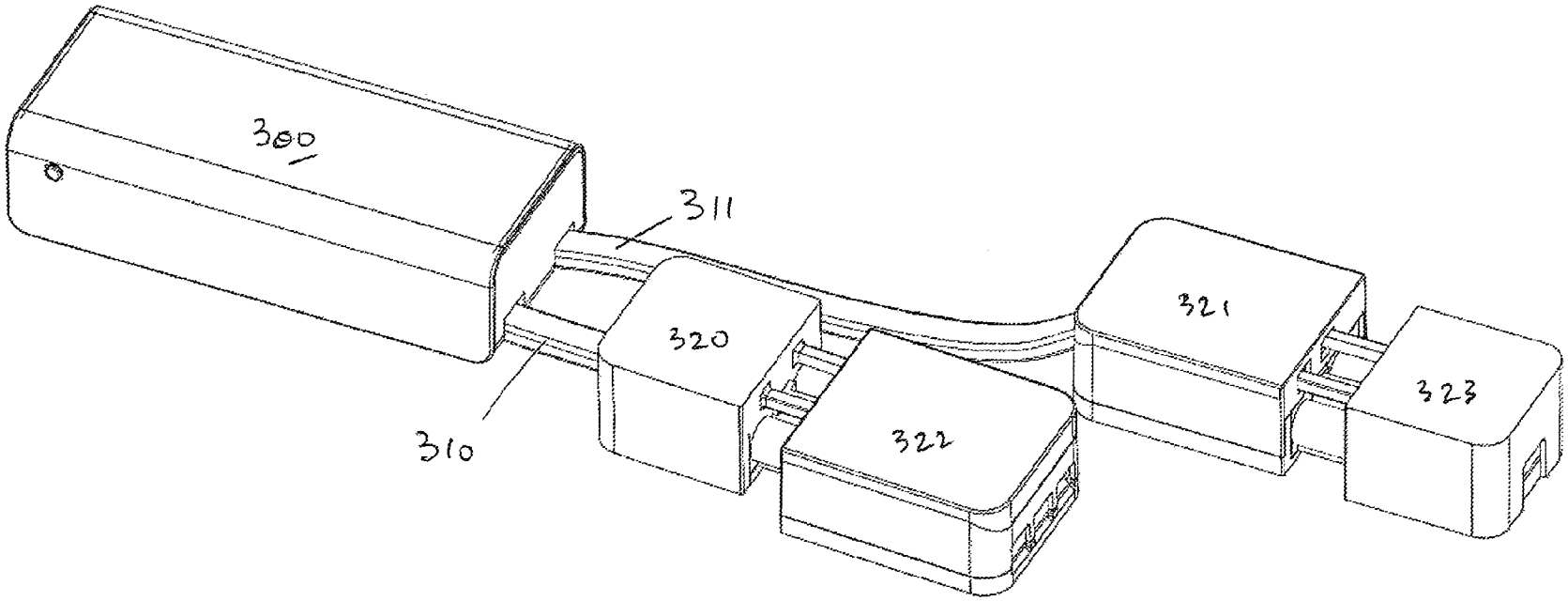
FIG. 11 illustrates the respective FASTFIX® connectors connected to each other.

FIGS. 7 to 11 illustrate a further embodiment of the present invention that may be wired in series into the powerline supplying power to a luminaire, or other item to be communicated with, or wired into plug-in type two part electrical connector blocks, as shown in FIGS. 10 and 11, and as described above. FIG. 7 illustrates an electronic 2-way communication module 300 with the side walls 301, 302 and base 303 of a housing assembly. The top or cover to the housing assembly has been removed for clarity, hut the complete housing assembly is shown in FIG. 9. The various components necessary to receive and transmit wireless signals and data, and to enable bi-directional powerline communication with the LED light engine in a lamp or luminaire, are housed within the housing assembly, together with terminal blocks 304, 305. Components housed here can include a wireless IC translating data in a 2-way nature with a Power Line Communications IC. During assembly, wires 310, 311 are attached to terminal blocks 304, 305 allowing the module to be connected in series with the live, neutral and earth power supply to a luminaire/light fitting or other electrical item with which it is compatible.

FIG. 10 shows the module 300 connected to female 320 and male 321 connector blocks of the quick release type, ready for connection to corresponding connectors 322, 323 wired into the power supply to the electrical item to be communicated with. This is shown more clearly in FIG. 11.

It will also be understood that luminaires and lamps are not the only devices that can be controlled using this invention. For example, the fan speed of a fan could be controlled using an electronic 2-way communication module according to the present invention.

The invention claimed is:

1. An electronic 2-way communication module suitable for 2-way communication with a luminaire and adapted to be installed into a power supply to said luminaire, wherein said electronic 2-way communication module comprises:

a housing assembly;

live and neutral power input terminals;

live and neutral power output terminals;

a power supply unit;

a dimmer unit controller;

a wireless communication interface adapted to receive data/operating instructions and to relay data to a remote repository; and a wired connection between said electronic 2-way communication module and said luminaire adapted for the 2-way transmission of data between the module and the luminaire and vice versa, wherein the wired connection comprises power line communication technology, and wherein the luminaire is connected to the power supply by means of a plug-in type two part electrical connector block, and wherein the housing assembly comprises a lock and release mechanism and complementary input and output terminals that are complementary to the corresponding features of the plug-in type two part electrical connector block of the luminaire, such that the electronic communication module can be installed in between the two parts of an existing connector block for fast and easy installation of the electronic communication module into the connector block of the luminaire without the need for any tools.

2. The electronic 2-way communication module according to claim 1, wherein said luminaire comprises an on-board dimmer unit, the dimmer unit controller controlling the on-board dimmer unit in the luminaire.

3. The electronic 2-way communication module according to claim 1, further comprising a dimmer unit.

4. The electronic 2-way communication module according to claim 3, wherein the dimmer unit is a TRIAC dimmer.

5. The electronic 2-way communication module according to claim 1, further comprising a power transfer and an AC communication unit.

6. The electronic 2-way communication module according to claim 1, further comprising a real time clock.

7. An electronic 2-way communication module suitable for 2-way communication with a luminaire and adapted to be installed into a power supply to said luminaire, wherein said electronic 2-way communication module comprises:

a housing assembly;

live and neutral power input terminals;

live and neutral power output terminals;

a power supply unit;

a dimmer unit controller;

a wireless communication interface adapted to receive data/operating instructions and to relay data to a remote repository; and a wired connection between said electronic 2-way communication module and said luminaire adapted for the 2-way transmission of data between the module and the luminaire and vice versa, and a memory module, wherein the memory module is adapted to store information regarding the functioning of the luminaire selected from a group of information comprising:

a number of times the luminaire has been turned on/off;

a total duration the luminaire has been illuminated;

a duration that has elapsed from the initiation of the luminaire;

a lumen output of an LED light engine associated with the luminaire when not dimmed;

an operating temperature of an LED light engine associated with the luminaire.

8. The electronic 2-way communication module according to claim 7, further comprising a touch sensor interface adapted as a user interface to detect user actions.

9. The electronic 2-way communication module according to claim 7, further comprising a status display unit.

10. The electronic 2-way communication module according to claim 7, further comprising a wireless IC adapted to translate data in a 2-way nature with a Power Line Communications IC.

11. The electronic 2-way communication module according to claim 7, further comprising a light engine comprising a programmable IC incorporating a dimming function.

12. The electronic 2-way communication module according to claim 11, wherein the programmable IC associated with the luminaire comprises one or more functionalities selected from the group of functions comprising:

Switch mode power supply control comprising bucking and fly-back topologies;

On chip temperature measurements;

Capacitive Touch and Proximity sensing;

Ambient light sensing for automatic night/day activation/deactivation;

Bi-directional Optical data transfer;

Power line communications;

Timer function comprising automatic;

Accepting commands from a normal wall dimmer switch, the commands comprising dimming;

Lumen maintenance;

Temperature management;

Colour temperature adjustment;

RGB control;

HV LED control, without requiring at least one of a transformer and an inductor;

PIR motion detection detectable by an external PIR; and

Smoke detection detectable by an external smoke detector.

* * * * *